US007504628B2

(12) United States Patent
Chen

(10) Patent No.: US 7,504,628 B2
(45) Date of Patent: Mar. 17, 2009

(54) NANOSCALE CORONA DISCHARGE ELECTRODE

(76) Inventor: Junhong Chen, 6710 99th Ave., Kenosha, WI (US) 53142

( * ) Notice: Subject to any disclaimer, the term of this patent is extended or adjusted under 35 U.S.C. 154(b) by 148 days.

(21) Appl. No.: 11/327,679

(22) Filed: Jan. 6, 2006

(65) Prior Publication Data

US 2006/0197018 A1 Sep. 7, 2006

Related U.S. Application Data

(60) Provisional application No. 60/641,858, filed on Jan. 6, 2005.

(51) Int. Cl.
*H01T 19/04* (2006.01)

(52) U.S. Cl. ..... 250/324; 250/423 R; 361/230; 361/231; 361/233

(58) Field of Classification Search ..... 250/324, 250/423; 361/230, 233, 231; 977/932, 939
See application file for complete search history.

(56) References Cited

U.S. PATENT DOCUMENTS

| | | | | |
|---|---|---|---|---|
| 895,729 | A | 8/1908 | Cottrell | |
| 3,604,925 | A * | 9/1971 | Snelling et al. | 250/326 |
| 6,646,856 | B2 * | 11/2003 | Lee et al. | 361/232 |
| 7,214,949 | B2 * | 5/2007 | Schlitz | 250/423 F |
| 2005/0141999 | A1 * | 6/2005 | Bonne | 417/48 |

FOREIGN PATENT DOCUMENTS

| | | |
|---|---|---|
| JP | 08160711 | 6/1996 |
| JP | 08160711 A * | 6/1996 |

OTHER PUBLICATIONS

Chen, et al ("Field emission of different oriented carbon nanotubes" Appl. Phys. Lett. 76(17) Apr. 24, 2000 pp. 2469-2471).*
American Lung Association, "Ozone Air Pollution," http://www.lungusa.org (2002) 10 pages.
Awad, M.B. et al., "Ozone generation in an electrostatic precipitator with a heated corona wire," Journal of the Air Pollution Control Association (1975) 25(4):369-374.
Baughman, R.H. et al., "Carbon nanotubes—the route toward applications," Science (2002) 297:787-792.
Boelter, K. et al., "Ozone generation by indoor electrostatic air cleaners," Aerosol Science and Technology (1997) 27(6):689-708.
Bonard, J.M. et al., "Field emission from carbon nanotubes: the first five years," Solid-State Electron. (2001) 45(6):893-914.
Buldum, A. et al., "Electron field emission properties of closed carbon nanotubes," Phys. Rev. Lett. (2003) 91(23):236801-236804.

(Continued)

*Primary Examiner*—Jack I Berman
*Assistant Examiner*—Michael Maskell
(74) *Attorney, Agent, or Firm*—Boyle Fredrickson, S.C.

(57) ABSTRACT

An electrode for atmospheric corona discharge apparatus provide a passive conductor whose surface is decorated with nanostructures such as carbon nanotubes. The nanotubes provide for a lower corona discharge initiation voltage and raise the possibility for reduced ozone production on corona discharge devices.

20 Claims, 2 Drawing Sheets

OTHER PUBLICATIONS

Chen, J.H. et al., "A global model of chemical vapor deposition of silicon dioxide by direct-current Corona discharges in air containing octamethylcyclotetrasiloxane vapor," Plasma Chemistry and Plasma Processing (2004) 24(4):511-535.
Chen, J.H. et al., "A simple and versatile mini-arc plasma source for nanocrystal synthesis," J. Nanoparticle Research (2006) 9(2):203-213.
Chen, J.H. et al., "Chemical vapor deposition of silicon dioxide by direct-current Corona discharges in dry air containing octamethylcyclotetrasiloxane vapor: measurement of the deposition rate," Plasma Chemistry and Plasma Processing (2004) 24(2):169-188.
Chen, J.H. et al., "Controlled decoration of carbon nanotubes with nanoparticles," Nanotechnology (2006) 17(12):2891-2894.
Chen, J.H. et al., "Effect of relative humidity on electron distribution and ozone production by DC coronas in air," IEEE Transactions on Plasma Science (2005) 33(2):808-812.
Chen, J.H. et al., "Electron density and electron energy distributions in the positive DC Corona: interpretation for Corona-enhanced chemical reactions," Plasma Chemistry and Plasma Processing (2002) 22(2):199-224.
Chen, J.H. et al., "Model of the negative DC Corona plasma: comparison to the positive DC Corona plasma," Plasma Chemistry and Plasma Processing (2003) 23(1):83-102.
Chen, J.H. et al., "Ozone production in the negative DC Corona: the dependence of discharge polarity," Plasma Chemistry and Plasma Processing (2003) 23(3):501-518.
Chen, J.H. et al., "Ozone production in the positive DC Corona discharge: model and comparison to experiments," Plasma Chemistry and Plasma Processing (2002) 22(4):495-522.
Chen, J.H., "Direct Current Corona-Enhanced Chemical Reactions," Ph.D. Thesis, Mechanical Engineering Department (2002) University of Minnesota, Minneapolis, 277 pages.
Cheng, Y. et al., "Electron field emission from carbon nanotubes," Comptes Rendus Physique (2003) 4(9):1021-1033.
Choi, S.J. et al., "A particle-in-cell simulation of dust charging and shielding in low-pressure glow-discharges," IEEE Transactions on Plasma Science (1994) 22(2):138-150.
Collins, P.G. et al., "A simple and robust electron beam source from carbon nanotubes," Appl. Phys. Lett. (1996) 69(13):1969-1971.
Collins, P.G. et al., "Extreme oxygen sensitivity of electronic properties of carbon nanotubes," Science (2000) 287(5459):1801-1804.
Collins, P.G. et al., "Unique characteristics of cold cathode carbon-nanotube-matrix field emitters," Phys. Rev. B. (1997) 55(15):9391-9399.
Cottrell, F.G., "The electrical precipitation of suspended particles," J. Ind. Eng. Chem. (1911) 3:542-544.
Dai, H.J., "Carbon nanotubes: opportunities and challenges," Surface Science (2002) 500(1-3):218-241.
Dresselhaus, M.S. et al., "Carbon nanotubes: continued innovations and challenges," MRS Bulletin (2004) 29(4):237-239.
Fan, S.S. et al., "Self-oriented regular arrays of carbon nanotubes and their field emission properties," Science (1999) 283(5401):512-514.
Garcia, A.L. et al., "Generation of the Chapman-Enskog Distribution," Journal of Computational Physics (1998) 140:66-70.
Hwang, G.S. et al., "Charging damage during residual metal overetching," Appl. Phys. Lett. (1999) 74(7):932-934.
Hwang, G.S. et al., "Pattern-dependent charging in plasmas," IEEE Transactions on Plasma Science (1999) 27(1):102-103.
Iijima, S. et al., "Single-shell carbon nanotubes of 1-nm diameter," Nature (1993) 363(6430):603-605.
Iijima, S., "Helical microtubules of graphitic carbon," Nature (1991) 354(6348):56-58.
Joshi, R.P. et al., "Microscopic analysis for water stressed by high electric fields in the prebreakdown regime," J. Appl. Phys. (2004) 96(7):3617-3625.
Jung, S.M. et al., "Clean carbon nanotube field emitters aligned horizontally," Nano Letters (2006) 6(7):1569-1573.
Kortshagen, U. et al., "On simplifying approaches to the solution of the Boltzmann equation in spatially inhomogenous plasmas," Plasma Sources Sci. Technol. (1996) 5:1-17.
Liang, S.D. et al., "Chirality effect of single-wall carbon nanotubes on field emission," Appl. Phys. Lett (2003) 83(6):1213-1215.
Lu, G.H. et al., "Electrostatic force directed assembly of Ag nanocrystals into vertically aligned carbon nanotubes," J. Phys. Chem. C (2007) 111(48):17919-17922.
Lu, G.H. et al., "Gas sensors based on tin oxide nanoparticles synthesized from a mini-arc plasma source," J. Nanomaterials (2006) p. 60828-60834.
Milne, W.I. et al., "Carbon nanotubes as field emission sources," J. Matl. Chem. (2004) 14(6):933-943.
Modi, A. et al., "Miniature gas ionization sensors using carbon nanotubes," Nature (2003) 424:171-174.
Nashimoto, K., "The effect of electrode materials on $O_3$ and $NO_x$ emissions by corona discharging," J. Imaging Sci. (1988) 32(5):205-210.
Nitschke, T.E. et al., "A comparison of particle-in-cell and fluid model simulations of low-pressure radio-frequency discharges," J. Appl. Phys. (1994) 76(10):5646-5660.
Radmilovic-Radjenovic, M. et al., "Particle-in-cell simulation of gas breakdown in microgaps," J. Phys. D: Appl. Phys. (2005) 38(6):950-954.
Rajaraman, K. et al., "A Monte Carlo simulation of radiation trapping in electrodeless gas discharge lamps," J. Phys. D. Appl. Phys. (2004) 37(13):1780-1791.
Ramalingam, S. et al., "Atomistic simulation of SiH interactions with silicon surfaces during deposition from silane containing plasmas," Appl. Phys. Lett. (1998) 72(5):578-580.
Ramalingam, S. et al., "Atomistic simulation study of the interactions of SiH3 radicals with silicon surfaces," J. Appl. Phys. (1999) 86(5):2872-2888.
Rosen, R. et al., "Application of carbon nanotubes as electrodes in gas discharge tubes," Appl. Phys. Lett. (2000) 76(13):1668-1670.
Saito, Y. et al., "Field emission from carbon nanotubes and its application to electron sources," Carbon (2000) 38(2):169-182.
Surendra, M. et al., "Particle simulations of radio-frequency glow discharges," IEEE Transactions on Plasma Science (1991) 19(2):144-157.
Treacy, M.M.J. et al., "Exceptionally high young's modulus observed for individual carbon nanotubes," Nature (1996) 38(6584):678-680.
U.S. Environmental Protection Agency, "Health and Environmental effects of ground-level ozone," http://www.epa.gov (2002) 2 pages.
Vahedi, V. et al., "A Monte-Carlo collision model for the particle-in-cell method: applications to argon and oxygen discharges," Comput. Phys. Commun. (1995) 87:179-198.
Ventzek, P.L.G. et al., "2-dimensional hybrid model of inductively-coupled plasma sources for etching," Appl. Phys. Lett. (1993) 63(5):605-607.
Viner, A.S. et al., "Ozone generation in DC-energized electrostatic precipitators," IEEE Trans. Ind. Appl. (1992) 28(3):504-512.
Wijesinghe, H.S. et al., "Three-dimensional hybrid continuum-atomistic simulations for multiscale hydrodynamics," J. Fluids Engineering (2004) 126(5):768-775.
Wijesinghe, H.S., "Hybrid Atomistic-Continuum Formulations for Gaseous Flows," in Mechanical Engineering Department (2003) Massachusetts Institute of Technology: Cambridge, Massachusetts, 156 pages.
Yu, M.F. et al., "Strength and breaking mechanism of multiwalled carbon nanotubes under tensile load," Science (2000) 287(5453):637-640.
Zhang, W. et al., "Simulation of ion generation and breakdown in atmospheric air," J. Appl. Phys. (2004) 96(11):6066-6072.
Zhong, D.Y. et al., "Universal field-emission model for carbon nanotubes on a metal tip," Appl. Phys. Lett. (2002) 80(3):506-508.
Zhu, L.Y. et al., "A generic approach to coat carbon nanotubes with nanoparticles for potential energy applications," J. Heat Transfer (2008) 130(4) In Press, 5 pages.
Zhu, L.Y. et al., "Ripening of silver nanoparticles on carbon nanotubes," NANO (2007) 2(3):149-156.
Zhu, W. et al., "Large current density from carbon nanotube field emitters," Applied Phys. Lett. (1999) 75(6):873-875.

* cited by examiner

NANOSCALE CORONA DISCHARGE ELECTRODE

CROSS-REFERENCE TO RELATED APPLICATIONS

This application claims the benefit of U.S. provisional application 60/641,858 filed Jan. 6, 2005 hereby incorporated by reference.

STATEMENT REGARDING FEDERALLY SPONSORED RESEARCH OR DEVELOPMENT

BACKGROUND OF THE INVENTION

The present invention relates to atmospheric corona discharge devices, and in particular, to an improved electrode for corona discharge devices.

Atmospheric, direct current (DC), corona discharge is used to provide a unipolar ion source for a variety of electrical devices including air cleaners, in which the ions charge particulates to draw them to a collector plate, and photocopiers and laser printers, in which the ions charge a photosensitive drum.

Atmospheric corona discharge, as its name suggests, employs a discharge electrode surrounded by air. A steep electrical gradient at the discharge electrode produces a plasma of ionized atoms or molecules near the discharge electrode. Some ions escape from the plasma region to form charge carriers that migrate to a second electrode. Atmospheric corona discharge is readily distinguishable from devices that provide a stream of electrons such as field emission devices and thermionic emission devices, each of which normally operate in a near or complete vacuum.

The plasma region in which the ions are generated may convert atmospheric oxygen ($O_2$) to ozone ($O_3$), the latter being a reactive gas that in high concentrations can be a health concern. Ozone can be reduced by using a positive voltage at the discharge electrode. Ozone can also be reduced by limiting discharge current, but at the cost of reducing the number of ions generated, and thus reducing the effectiveness of the associated equipment. Air temperature and air velocity are not major factors in the control of ozone creation for most indoor applications.

The ionization of air by the discharge electrode is influenced by the sharpness (radius of curvature) of the discharge electrode such as increases the gradient of the electrical field about the discharge electrode. This relationship is captured in the empirically derived Peek's equation. Experimental data for different electrode radii as low as 10 micrometers also indicate a reduced ozone production for a given surface current density as the electrode radius decreases.

For these reasons, commercial corona devices have employed wire electrodes as small as one micrometer in radius. Such wires provide a small radius of curvature, reducing ozone production and discharge voltage (and thus discharge power consumption) while maintaining an acceptable ion production rate.

The ability to further decrease the wire size is limited by practical considerations of wire strength and durability in the typical operating environment of an atmospheric corona discharge device.

SUMMARY OF THE INVENTION

The present invention addresses the problem of producing a robust discharge electrode with a small radius of curvature by coating a conductive substrate such as a metal wire or plate with nanostructures, for example, carbon nanotubes. The small radius of curvature of the nanotubes provides for a high electrical field strength that may reduce power consumption for a given ion production rate by lowering the necessary voltage needed to produce a given current flow. It is also believed that the small radius of curvature, by reducing the volume of the corona plasma region, will further reduce the interaction of the plasma with oxygen molecules and thus the production of ozone.

Specifically then, the present invention provides a corona discharge electrode having a conductive support adapted to be exposed to the air and to receive an electrical voltage. A plurality of conductive nanostructures is attached to, and in electrical communication with, the conductive support. The nanostructures are arranged to provide electrode tips positioned to extend into the surrounding air and having radii less than 100 nanometers to ionize the air at the nanostructure with the electrical voltage.

Thus it is an object of at least one embodiment of the invention to provide for extremely small electrode radii using nanostructures, which include nanotubes, nanowires, nanorods, and nanoparticles.

The nanostructures may be carbon nanotubes having first ends attached to the conductive support, and second ends extending outward from the conductive support.

It is thus another object of at least one embodiment of the invention to provide an nanostructure configuration that can significantly increase the ionization area of the substrate.

The carbon nanotubes may be preselected according to whether they are metallic.

Thus, it is an object of at least one embodiment of the invention to select nanotubes for improved electrode operation and resistance to erosion.

Alternatively, the nanostructures may be carbon nanotubes having a side attached to the conductive support.

Thus, it is an object of at least one embodiment of the invention to provide for a simple fabrication technique in which nanotubes are arrayed over a substrate without alignment.

The substrate may be either a plate or a wire.

Thus, it is an object of at least one embodiment of the invention to provide a flexible electrode design that may match well with the particular application requiring atmospheric corona discharge.

These particular objects and advantages may apply to only some embodiments falling within the claims and thus do not define the scope of the invention.

DETAILED DESCRIPTION OF THE PREFERRED EMBODIMENT

Figure 1:
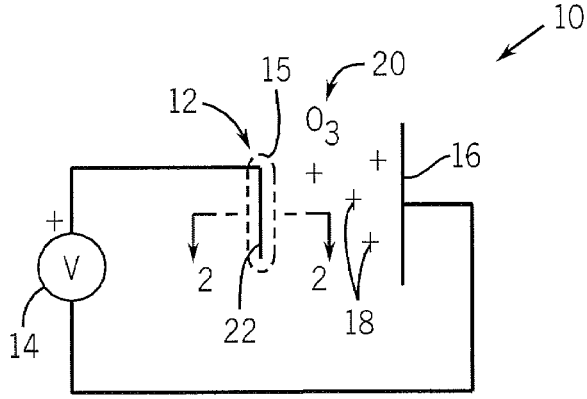
FIG. 1 is a schematic representation of a corona discharge device such as may make use of the present invention using a wire discharge electrode.

Referring now to FIG. 1, an atmospheric corona discharge device 10 may provide for a discharge electrode 12 connected to one terminal of a voltage source 14, the other terminal of which is connected to a return electrode 16.

In a xerographic system such as a copier or printer, the return electrode 16 may be a xerographic plate attracting toner after it has been charged by the atmospheric corona discharge device 10 and photo exposed. In a filtration system, return electrode 16 may be a collector plate for collecting charged dust particles charged by the atmospheric corona discharge device 10. In a gas chromatograph-mass spectrometer, the return electrode 16 may be an accelerating or analyzing electrode.

The high radius of curvature of the discharge electrode 12 produces a region of high gradient electrical field causing electrical disassociation of the atmosphere gases about the discharge electrode 12 producing a plasma region 15 of ions some of which escape as charge carriers 18. The charge carriers are unipolar ions of the same polarity as the discharge electrode. The charge carriers 18 may impart a charge to the return electrode 16 or react with other particles such as dust to charge the dust and cause it to collect on return electrode 16. Oxygen passing into the plasma region 15 may become ozone 20.

Figure 2:
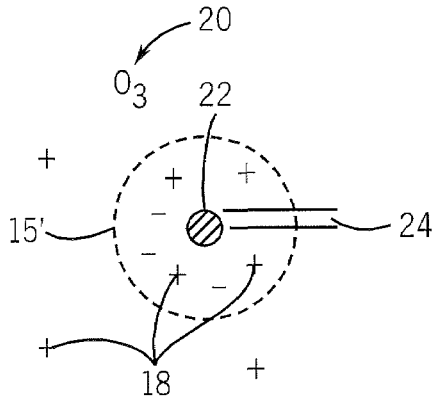
FIG. 2 is a cross-sectional view through the discharge electrode of FIG. 1 showing a plasma region that would be expected based on the radius of the wire.

Referring now also to FIG. 2, the electrode 12 may be a wire 22 having a radius 24 typically as small as one micrometer. In commercial devices using the wire 22 alone as a discharge electrode 12, a relatively large plasma region 15' will be created that promotes the formation of ozone 20.

Figure 3:
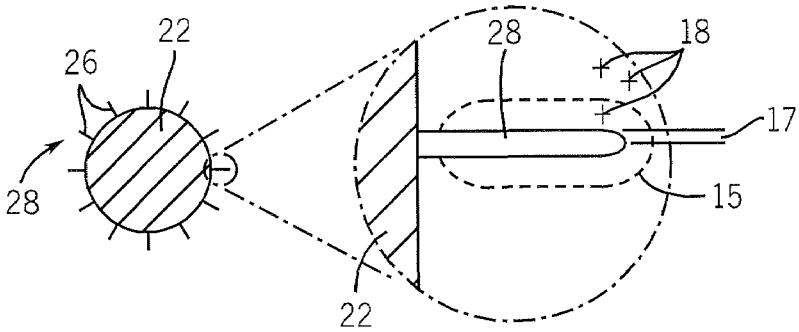
FIG. 3 is an enlarged cross-sectional view of the wire of FIG. 2 showing the endwise attachment of carbon nanotubes to provide for small radius discharge electrodes providing small volume plasma regions.

Referring now to FIG. 3, in the present invention, the wire 22 is provided with a surface coating of nanostructures 26. In this case, single or multi walled carbon nanotubes 28 are arranged with one end of the nanotubes 28 attached to the outer periphery of the wire 22, and the other end extending radially therefrom. It is believed that the nanotubes 28 may be grown directly off the wire 22 in upright configuration and with a controlled separation. Alternatively, the nanotubes 28 may be attached to the wire 22 after fabrication by their sidewall in a "layed down" configuration.

The extremely small radius 17 of the nanotubes 28, less than 100 nm and typically on the order of a few nanometers, produces an extremely small volume of plasma region 15 in proportion to a discharge area (such as defines the current flow into the plasma region 15). Accordingly, dependent in part on the orientation, spacing and length of the carbon nanotube 28, the discharge area may be controlled independently of the volume of the plasma region 15 to decrease the formation of ozone while maintaining a high production of charge carriers.

Generally, the radius 17 is smaller than the mean free path of charge carriers 18 in the plasma region 15.

Peek's equation generally predicts that the higher radius of curvature of the nanotubes will also decrease the voltage necessary to produce atmospheric corona discharge, decreasing the power needed for corona discharge. However, it was not known whether Peek's equation breaks down for very small radii because Peek's equation is empirically based. One possibility is that an increase in field emission for small radii may cause early initiation of a negative corona preventing advantageous production of positive coronas for reduced ozone production. As will be described below, however, the present inventor has determined that the decrease in radius of carbon nanotubes does result in a decrease in corona initiation voltage.

Figure 4:
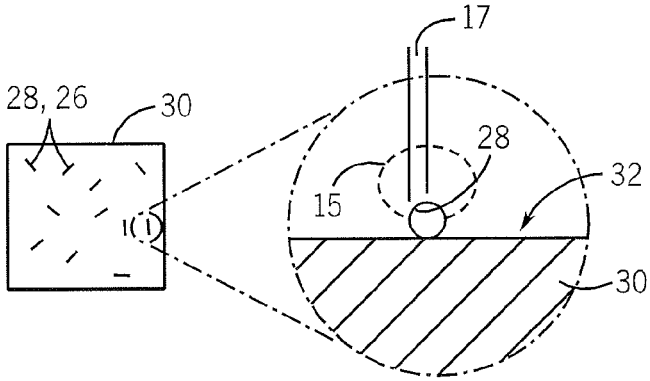
FIG. 4 is an alternative embodiment of the electrode of FIG. 3 showing a plate electrode having carbon nanotubes attached on their sides to the plate.

Referring now to FIG. 4, wire 22 may be replaced with a plate 30 which may have upwardly extending nanotubes per FIG. 3 or may have nanotubes 28 that are laid down against a surface 32 of the plate 30 providing a substantially simpler fabrication technique that similarly produces a small volume plasma region 15 relative to discharge area. Again, the nanotubes 28 may be grown directly off the plate 30 in upright configuration or distributed and adhered by electrostatic techniques to coat the surface.

The nanostructures 26 may alternatively be other nanostructures that provide for conduction such as are well known in the art. Nanoparticles can be produced with chemical vapor deposition (CVD) and may be grown on the substrate or placed after growth by dispersion.

When the nanostructures are single walled nanotubes, they may be preselected for use depending on whether they are metallic or semiconducting. Generally, one-third of nanotubes will be metallic, and two-thirds semiconductor in a random sample, but they may be separated according to their metallic and semiconducting properties according to empirically determined efficiency and resistance to erosion.

The improved corona discharge may be useful in charging nanostructures themselves, and thus may be used for the production of the electrodes according to the present invention.

EXAMPLE I

A discharge electrode 12 was prepared by coating a commercial transmission electron microscope (TEM) copper grid with multi-walled carbon nanotubes about 40 nanometers in diameter and dispersed in methanol and commercially available from Buckey USA of Houston, Tex., U.S.A. As a comparison, an identical TEM grid electrode, a TEM grid electrode and tungsten wire electrode about three millimeters long and 200 micrometers in diameter, were also studied.

Figure 5:
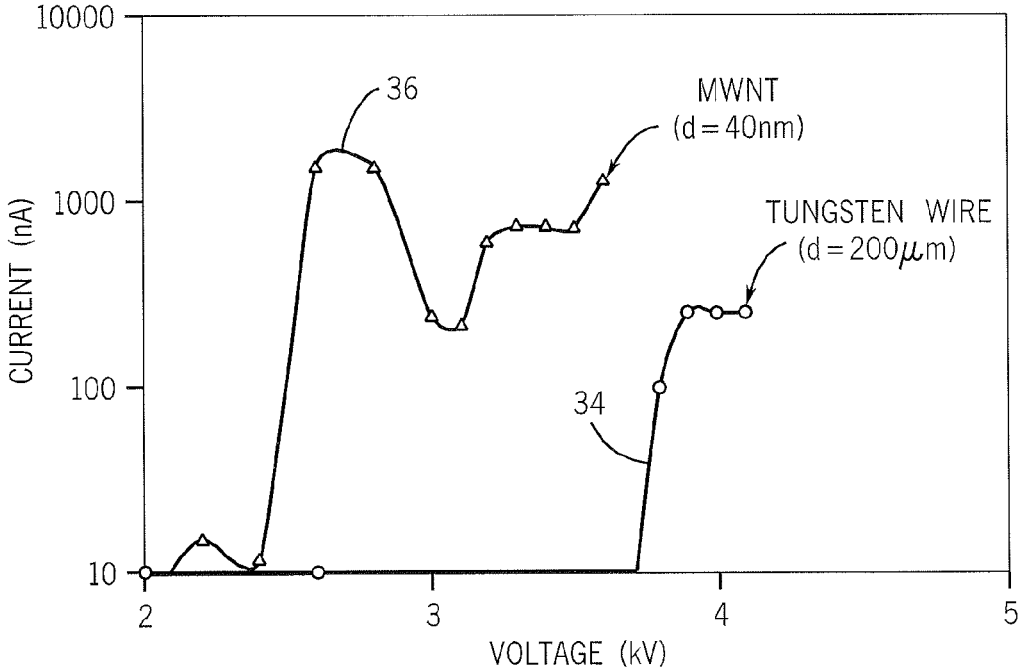
FIG. 5 is a graph showing an experimental measurement of the VI curve using the embodiment of FIG. 4.

Referring to FIG. 5, the voltage current (VI) plot of the grids with the nanotubes and with the tungsten wire are shown. Plot 34 shows the tungsten wire grid and plot 36 shows the carbon nanotube grid. For the TEM grid with the nanotube, a corona discharge was initiated at 2.4 kV with a current of 1,531 nanoamps at a voltage of 2.6 kV. For the tungsten electrode, the corona initiated at about 3.8 kV and around 230 nanoamps for a maximum voltage of 4.1 kV. In comparison, for the TEM grid only, a maximum current of 20 nanoamps was obtained for a maximum voltage of four kV.

It is specifically intended that the present invention not be limited to the embodiments and illustrations contained herein, but include modified forms of those embodiments including portions of the embodiments and combinations of elements of different embodiments as come within the scope of the following claims.

I claim:

1. A corona discharge electrode comprising:

a conductive support adapted to be exposed to air and to receive an electrical voltage;

a plurality of conductive nanostructures attached to and in electrical communication with the conductive support, wherein the nanostructures have a side attached to the conductive support;

the nanostructures arranged to provide electrodes extending into surrounding air and having radii less than 100 nm to ionize the air at the nanostructure with the electrical voltage.

2. The corona discharge electrode of claim 1 wherein the nanostructures are carbon nanotubes.

3. The corona discharge electrode of claim 2 wherein the carbon nanotubes are metallic.

4. The corona discharge electrode of claim 1 wherein the conductive support is a wire and wherein the nanostructures are distributed over side surface of the wire.

5. The corona discharge electrode of claim 1 wherein the conductive support is a plate and the nanostructures are distributed over a broad face of the plate.

6. A corona discharge assembly comprising:

a chamber open to air and having an ion discharge opening;

a first conductive surface positioned within the chamber;

a second conductive surface having a front facing the first conductive surface;

an electrical power supply communicating with the first and second conductive surfaces to apply a voltage there across; and a plurality of conductive nanostructures dispersed over and in electrical communication with an area of the front of the second conductive support, wherein the nanostructures have a side attached to the conductive support, the nanostructures arranged to provide electrodes extending into surrounding air and having radii less than 100 nm.

7. The corona discharge assembly of claim 6 wherein the nanostructures are carbon nanotubes.

8. The corona discharge assembly of claim 7 wherein the carbon nanotubes are preselected according to whether they are metallic.

9. The corona discharge assembly of claim 6 wherein the conductive support is a wire and wherein the nanostructures are distributed over the surface of the wire.

10. The corona discharge assembly of claim 6 wherein the conductive support is a plate and the nanostructures are attached along a broad face of the plate.

11. The corona discharge assembly of claim 6 wherein the second conductive surface is a xerographic plate.

12. The corona discharge assembly of claim 6 wherein the electrical power supply provides a voltage limited to promote corona discharge substantially only by the nanostructures and not by the second conductive support.

13. The corona discharge assembly of claim 6 wherein the electrical power supply provides a voltage of less than 3 kV.

14. A method of reducing ozone production in a corona discharge apparatus having an electrical power supply providing a substantially continuous positive voltage to a first conductive surface with respect to a second conductive surface exposed to air, the method comprising the steps of:

applying a plurality of conductive nanostructures having a radii less than 100 nm to the first conductive surface the nanostructures extending over a dimension of at least substantially 3 mm, wherein the nanostructures have a side attached to the conductive surface, the conductive nanostructures positioned to reduce a volume of corona discharge region around each nanostructures for a given current flow through the one conductive surface.

15. The method of claim 14 wherein the nanostructures are carbon nanotubes applied to the first conductive surface dispersed in a liquid carrier.

16. The method of claim 15 wherein the carbon nanotubes are metallic.

17. The method of claim 14 wherein the first conductive surface is a wire and wherein the nanostructures are distributed over the surface of the wire.

18. The method of claim 14 wherein the first conductive surface is a plate.

19. The method of claim 14 wherein the second conductive surface is a xerographic plate.

20. The method of claim 14 wherein the electrical power supply provides a voltage of less than 3 kV.

* * * * *